United States Patent [19]

Jones

[11] Patent Number: 4,988,096

[45] Date of Patent: Jan. 29, 1991

[54] MUSCULAR STRETCHING APPARATUS

[76] Inventor: David W. Jones, Rte. #2, Box 714 Nettie Dr., Ashland City, Tenn. 37015

[21] Appl. No.: 390,981

[22] Filed: Aug. 7, 1989

[51] Int. Cl.[5] ..... A63B 21/06

[52] U.S. Cl. ..... 272/118; 272/117; 272/119; 272/121; 272/903

[58] Field of Search ..... 272/117-119, 272/121, 131-134, 139, 141-142, 903

[56] References Cited

FOREIGN PATENT DOCUMENTS 2512348 9/1981 France ..... 272/118

*Primary Examiner*—Richard J. Apley

*Assistant Examiner*—Lynne A. Reichard

*Attorney, Agent, or Firm*—Leon Gilden

[57] ABSTRACT

A muscular stretching apparatus for stretching an individual's legs is set forth wherein a plurality of rings are secured to an individual flexible line with a weighted member secured at the other end thereof. The flexible line is directed through a lower and upper pulley arrangement formed forwardly of a trapezoidal framework. The lower pulley arrangement includes a "C" shaped member with an adjustment pin directed orthogonally therethrough receivable within one of a series of apertures secured to a forward face of a generally "H" shaped guide block. The upper pulley arrangement is vertically positionable relative to the trapezoidal framework.

7 Claims, 4 Drawing Sheets

MUSCULAR STRETCHING APPARATUS

BACKGROUND OF THE INVENTION

1. Field of the Invention

The field of invention relates to exercise apparatus, and more particularly pertains to a new and improved muscular stretching apparatus wherein the same enables a stretching of an individual's legs.

2. Description of the Prior Art

The use of exercise apparatus to direct a resistance force against various portions of the muscular or skeletal configuration of an individual is well known in the prior art. Effectiveness of such devices will vary dependent upon the physiology of individuals involved. The instant invention has attempted to overcome deficiencies of the prior art by providing a muscular stretching device accommodating various sized individuals. The prior art includes for example, U.S. Pat. No. 3,323,366 to Lorme, et al., providing a muscular exercise device associated with a registration gauge to effect an evaluation of an individual during an exercise program.

U.S. Pat. No. 3,109,646 to Klein provides a stretching apparatus utilizing a planar member including an orthogonally directed post medially therethrough associated with a lowermost base positionable about an individual's foot to effect a stretching motion thereof.

U.S. Pat. No. 3,921,975 to Pridgen provides for a leg muscle exercise apparatus used interiorly of an individual's stretched legs to provide resistance to the legs during contraction of the interior muscles of the leg thereof.

U.S. Pat. No. 3,834,694 to Pridgen provides a cable leg stretching device wherein an individual lying in a horizontal orientation effects movement of the legs from a vertical to a horizontal position against a weighted resistance.

U.S. Pat. No. 4,277,062 to Lawrence provides a leg cable stretching device utilizing an elongate tubular member telescopingly adjustable with leg securement straps to enable an individual to position legs therethrough for resistant stretching of the legs.

As such, it may be appreciated that there is a continuing need for a new and improved muscular stretching apparatus wherein the same addresses both the problems of ease of use and effectiveness in construction, and in this respect, the present invention substantially fulfills this need.

SUMMARY OF THE INVENTION

In view of the foregoing disadvantages inherent in the known types of exercising apparatus now present in the prior art, the present invention provides a muscular stretching apparatus wherein the same provides an adjustably positionable apparatus to effect stretching of an individual's legs. As such, the general purpose of the present invention, which will be described subsequently in greater detail, is to provide a new and improved muscular stretching apparatus which has all the advantages of the prior art stretching apparatus and none of the disadvantages.

To attain this, the present invention includes a trapezoidal framework including upper and lower pairs of pulley assemblies. The upper pulley assembly is arranged adjacent opposed terminal ends of an upper beam of the framework, wherein the lower pulley assemblies are each positioned adjacent outer terminal ends of the lower framework. The lower pulley assembly utilizes an "H" shaped guide block provided with blind bores therewithin receiving a "C" shaped positioning bar receiving the lower pulley adjustably therethrough and rotatably mounted upon a respective locating pin. An elongate, flexible line is formed with a first end formed with a weighted member and its other end formed with a leg strap securable about an individual's legs, wherein each flexible line is directed to the upper and lower pulleys to orient the straps for convenient use by an individual. The upper pulley assemblies are vertically mountable within vertical beams formed within the trapezoidal framework.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved muscular stretching apparatus which has all the advantages of the prior art exercising apparatus and none of the disadvantages.

It is another object of the present invention to provide a new and improved muscular stretching apparatus which may be easily and efficiently manufactured and marketed.

It is a further object of the present invention to provide a new and improved muscular stretching apparatus which is of a durable and reliable construction.

An even further object of the present invention is to provide a new and improved muscular stretching apparatus which is susceptible of a low cost of manufacture with regard to both materials and labor, and which accordingly is then susceptible of low prices of sale to the consuming public, thereby making such muscular stretching apparatus economically available to the buying public.

Still yet another object of the present invention is to provide a new and improved muscular stretching apparatus which provides in the apparatuses and methods of the prior art some of the advantages thereof, while simultaneously overcoming some of the disadvantages normally associated therewith.

Still another object of the present invention is to provide a new and improved muscular stretching apparatus wherein the same utilizes adjustably positionable pulleys to orient a respective leg strap or a pair of leg straps for use by an individual.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
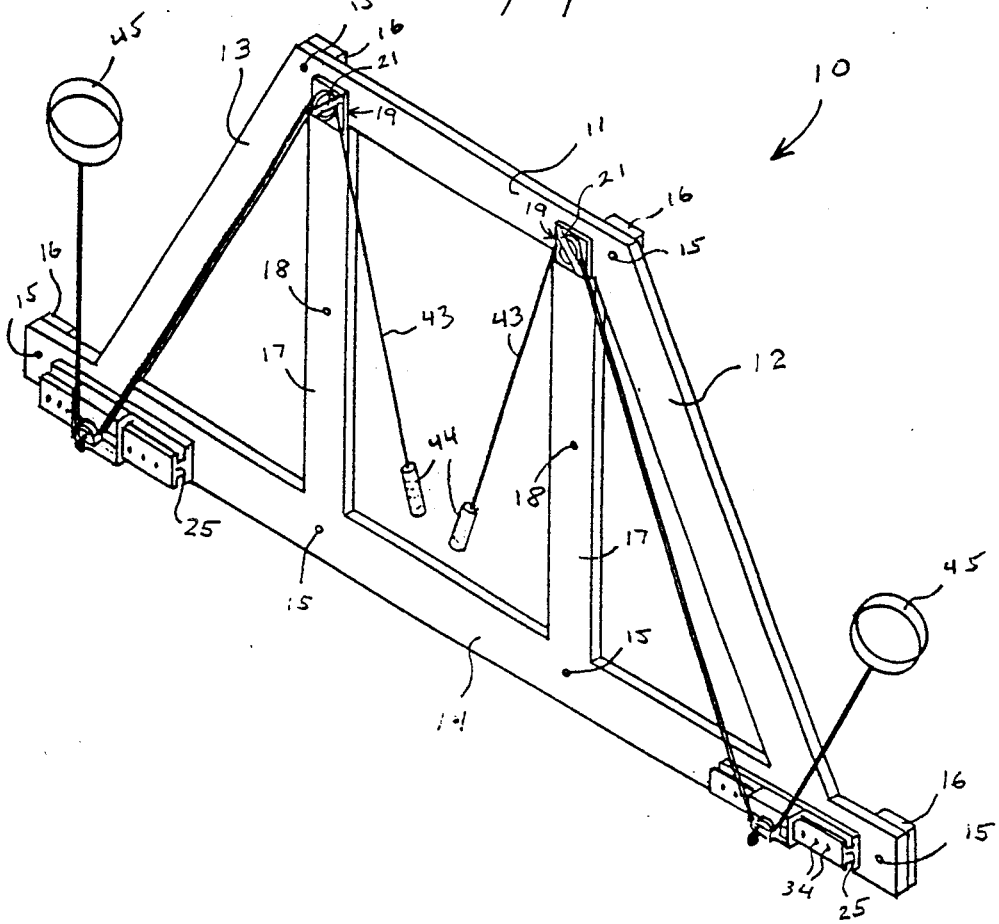
FIG. 1 is an isometric illustration of the instant invention.

With reference now to the drawings, and in particular to FIGS. 1 to 10 thereof, a new and improved muscular stretching apparatus embodying the principles and concepts of the present invention and generally designated by the reference numeral 10 will be described.

Figure 2:
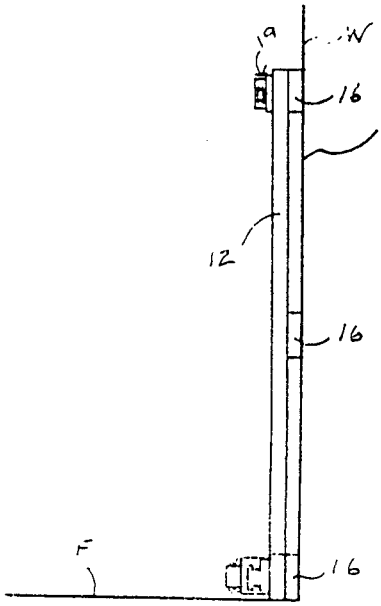
FIG. 2 is an orthographic side view of the instant invention, taken in elevation.

More specifically, the muscular stretching apparatus 10 of the instant invention essentially comprises a trapezoidal framework defined by a top beam 11 parallel to and mounted medially above a bottom beam 14 with a right side beam 12 and a left side beam 13 secured at their upper ends to outer terminal ends of the top beam 11 and at their bottom ends adjacent outer terminal ends of the bottom beam 14. Securement apertures 15 are directed orthogonally through the beams 11, 12, 13, and 14 in combination wit spacer blocks 16 directed behind the beams secured to rear surfaces of the respective beams to secure the framework against a support wall "W" overlying a floor "F", as illustrated in FIG. 2 for example. Vertical beams 17 are secured to the top beam 11 adjacent its outer terminal ends and directed downwardly and in orthogonal relationship relative to the bottom beam 14. The vertical beams 17 have secured at the intersection with the top beam 11 the upper roller guides 19, which may be vertically repositioned to lower adjustment apertures 18 positioned somewhat medially of the vertical beams 17.

Figure 3:
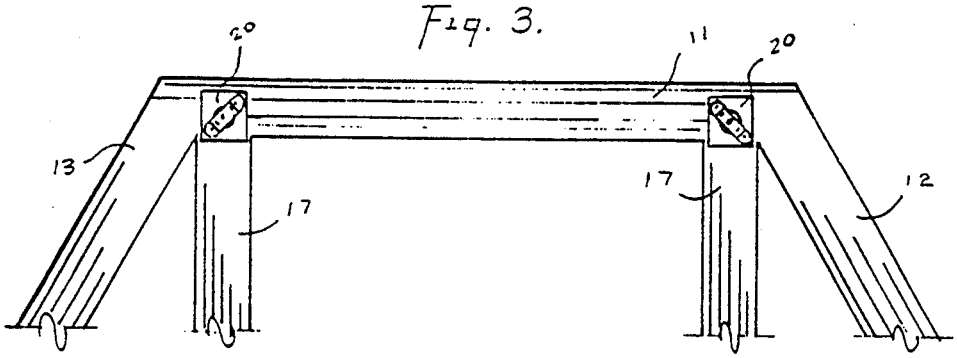
FIG. 3 is an orthographic illustration of a top portion of the trapezoidal framework.
Figure 4:
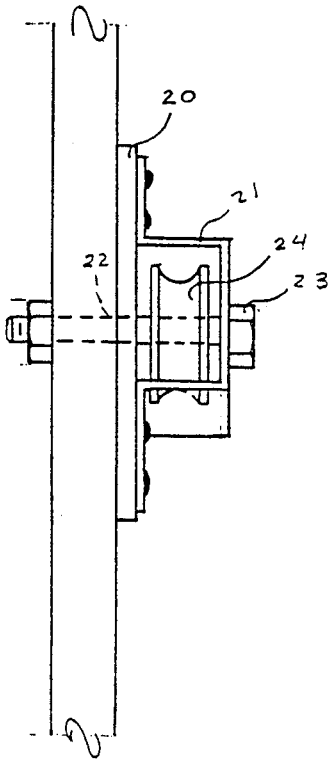
FIG. 4 is an orthographic side view taken in elevation of an upper pulley assembly.
Figure 5:
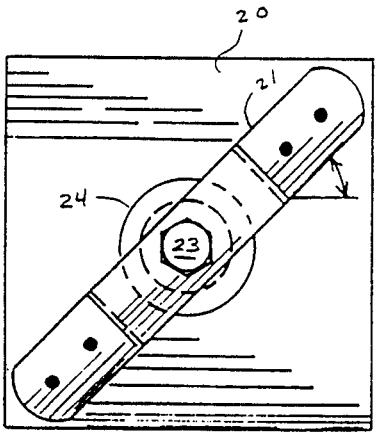
FIG. 5 is a frontal orthographic view taken in elevation of an upper pulley assembly.
Figure 6:
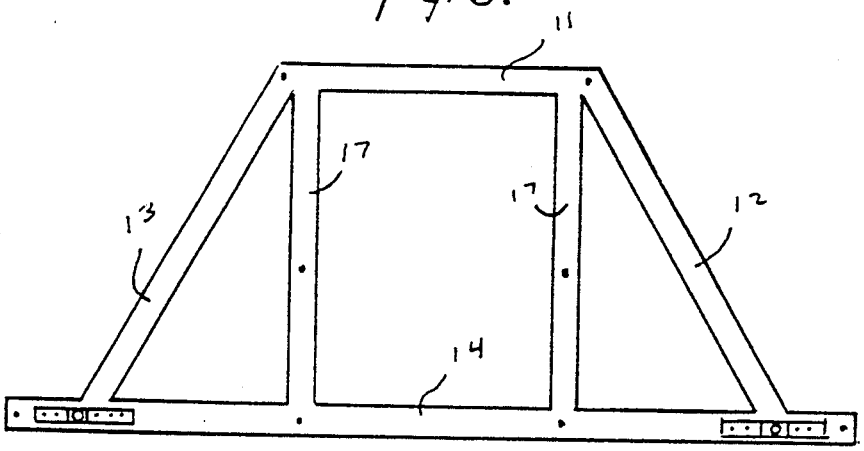
FIG. 6 is an orthographic view taken in elevation of the trapezoidal framework of the instant invention.

The upper roller guides 19 are each formed with a planar support plate 20 of a generally square configuration with an overlying "U" shaped guide strap 21 arranged at a forty-five degree angle relative to the support plate 20, wherein a securement aperture 22 is directed through the top beam 11 at the intersection with the vertical beam 17 to receive an upper securement fastener 23 therethrough that rotatably mounts an upper guide pulley 24 thereabout. The forty-five degree angular orientation of the guide strap 21, as illustrated in FIGS. 3 and 5 for example, enables each of the flexible lines utilized by the instant invention to be directed through a respective right and left upper guide pulley 24 while capturing the line and preventing the line from inadvertent slippage and removal from contact with a respective upper guide pulley 24. It should be noted, as illustrated in FIG. 1, that each of the guide straps 21 are arranged with an included forty-five degree angle as measured between a respective left and side edge of each respective left and right guide strap 21.

Figure 7:
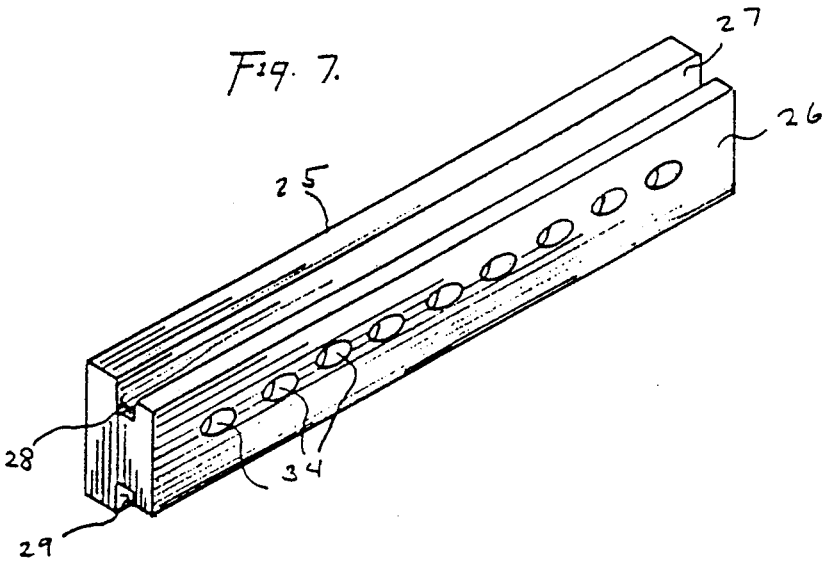
FIG. 7 is an isometric illustration of a guide block utilized by the instant invention.
Figure 8:
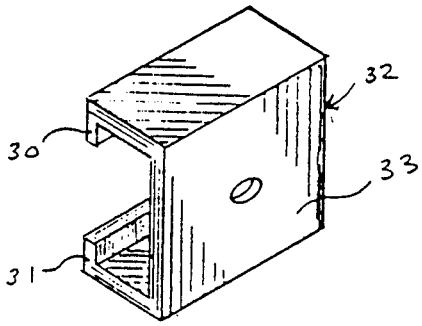
FIG. 8 is an isometric illustration of a "C" shaped positioning bar utilized by the instant invention in association with the guide block of FIG. 7.
Figure 9:
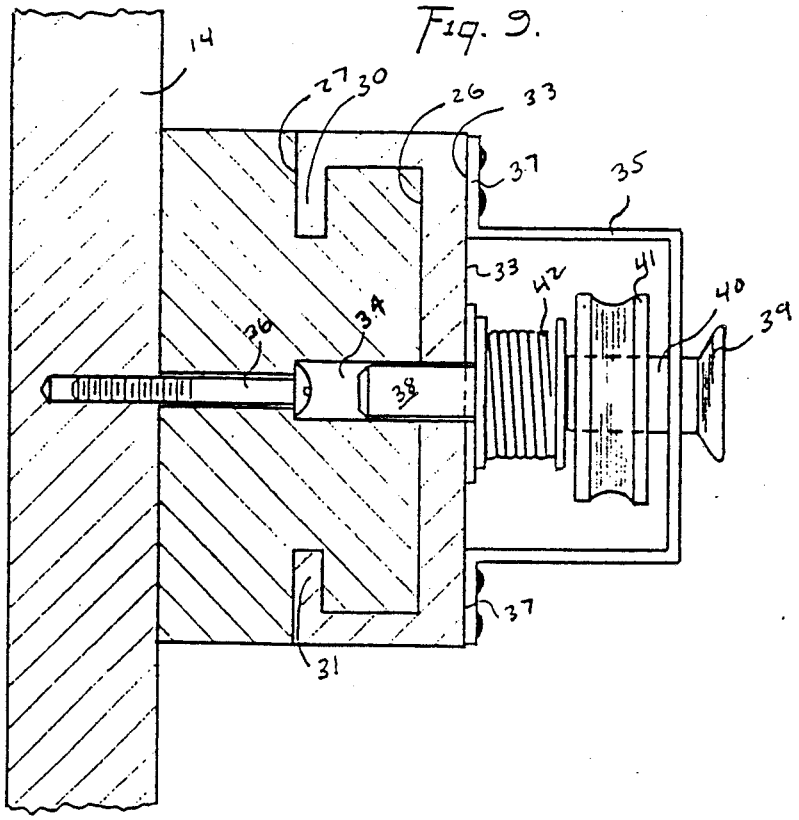
FIG. 9 is an orthographic cross-sectional view illustrating a lower pulley assembly in association with the trapezoidal framework.
Figure 10:
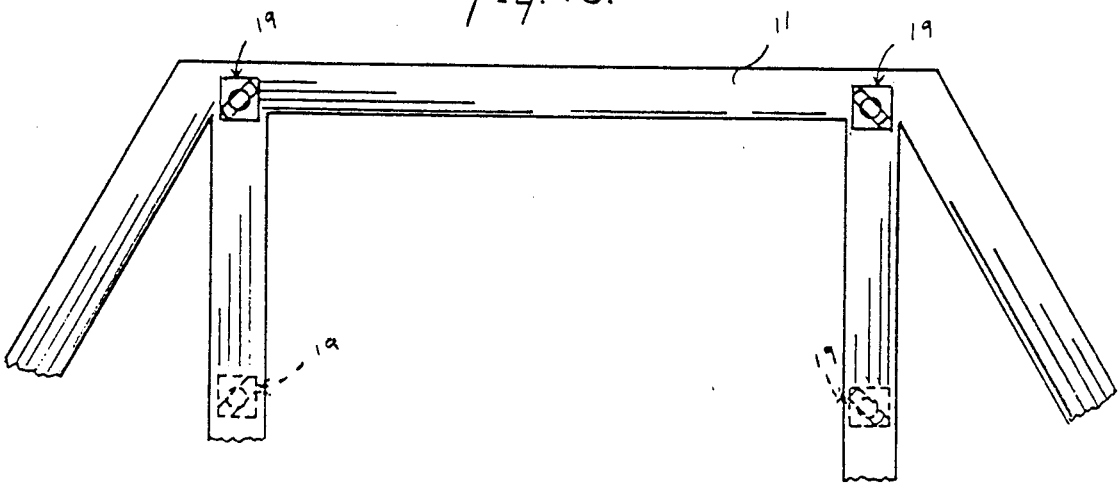
FIG. 10 is an orthographic frontal view taken in elevation of the trapezoidal framework and the illustration of the upper pulley assemblies in an adjusted position relative to the framework.

The lower roller guide apparatus includes a respective elongate "H" shaped guide block 25 positioned in and aligned in parallel relationship relative to opposed terminal ends of the bottom beam 14. The "H" shaped guide block includes a forward wall 26 (as illustrated in FIG. 7) of a reduced height relative to a rear wall 27 defining an upper groove 28 and a lower groove 29 between the forward and rear walls arranged at upper and lower sides of the "H" shaped guide block 25. The respective grooves receive a respective upper and lower flange 30 and 31 of a "C" shaped positioning bar 32 of a height substantially equal to that of the rear wall 27 with each respective flange of a height substantially equal to that of a respective groove slidably receiving the respective flange therewithin. The "C" shaped positioning bar 32 includes a forward face 33 of an interior height substantially equal to that of the forward wall 26 and formed with an aperture directed medially therethrough to receive a locating pin 38 directed through the aperture of the forward face 33 and received within one of a series of blind bores 34 formed through the forward wall 26 of the guide block 25. A lower fastener 36 secures the guide block 25 to the lower beam 14 wherein an overlying "U" shaped cage 35 is secured to overlie the forward face 32 and orient the locating pin 38 orthogonally through the forward face 32 with an enlarged head 39 positioned exteriorly of the "U" shaped cage 35 and formed with a bearing shank 40 directed interiorly of the "U" shaped cage to rotatably mount a lower guide pulley 41 thereabout with a captured coil spring 42 positioned between the lower guide pulley 41 and the forward face 33 to normally bias the location pin interiorly of a respective blind bore 34. To horizontally reposition the lower pulley 41, an individual merely grasps the enlarged head 39 to withdraw the associated location pin from a respective blind bore and enable the positioning bar 32 to slidingly be relocated about the guide block 25. Accordingly, the upper roller guides 19 may be vertically repositioned from the securement apertures 22 to the lower adjustment apertures 18 formed somewhat medially of the respective vertical beams 17, as illustrated in FIG. 10 for example.

Each of the pair of flexible lines 43 are directed through a lower pulley 41 and then about an upper pulley 24. The flexible line includes a leg securement ring 45 at an outer terminal and a weighted member 44 at an inner terminal end to normally bias the securement rings in a retracted position relative to a respective lower roller guide assembly.

In use, an individual merely positions a respective leg through a respective securement ring 45 and in a horizontal position with the individual's legs in confronting relationship relative to the apparatus 10 the individual stretches the legs by effecting repositioning of the legs against the resistance of the weighted member 44 normally biasing the legs inwardly of the apparatus.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A muscular leg stretching apparatus comprising, in combination, a framework arranged for securement to a support structure including an upper beam spaced medially above a lower beam, the framework including a right and left vertical beam arranged parallel to one another and orthogonally joined at the respective upper and lower terminal ends to the upper and lower beams respectively, and right and left upper guide means secured to a respective right and left intersection defined by an upper junction of an upper terminal end of each respective right and left vertical beam with the upper beam, and a right and left lower guide means secured to the lower beam exteriorly of a lower right and left junction defined by the intersection of the lower terminal ends of each right and left horizontal beam with the bottom beam, and a right and left flexible line respectively directed through each respective right and left upper and lower guide means, the right and left flexible line including a leg strap at an outer terminal end of each line and a weighted resistance member secured to an inner terminal end of each line, and wherein each upper guide means includes a square support plate with a "U" shaped guide strap overlying the support plate, and an upper fastener directed medially through the guide strap and the support plate and received within an upper aperture formed through the upper beam wherein the fastener includes an upper guide pulley rotatably mounted thereabout.

2. A muscular leg stretching apparatus as set forth in claim 1 wherein each left and right vertical beam includes an adjustment aperture positioned medially thereof for selective reception of the securement fastener of the upper guide means.

3. A muscular leg stretching apparatus as set forth in claim 2 wherein each lower guide means includes an elongate "H" shaped block slidably receiving a positioning bar thereon, the positioning bar mounting a lower guide pulley thereon.

4. A muscular leg stretching apparatus as set forth in claim 3 wherein the "H" shaped guide block includes a rear face of a height greater than that of a forward face with an upper and lower groove defined between each upper and lower face, the upper and lower groove receiving a respective upper and lower flange of the "C" shaped positioned bar, the "C" shaped positioning bar defining an internal height substantially equal to that of the forward face of the "H" shaped guide block, and the forward face of the "H" shaped guide block including a series of blind bores positioned therethrough, each of the blind bores arranged for reception of a location pin mounted through the "C" shaped positioning bar and rotatably mounting a lower guide pulley rotatably thereon.

5. A muscular leg stretching apparatus as set forth in claim 4 wherein a "U" shaped cage overlies a forward face of the "C" shaped positioning bar and is fixedly mounted thereon, wherein the "U" shaped cage orthogonally receives the location pin therethrough, the location pin including a coil biasing spring to normally bias the location pin interiorly of one of the blind bores.

6. A muscular leg stretching apparatus as set forth in claim 5 wherein the framework includes a matrix of securement apertures therethrough, each of the securement apertures overlying a spacer block, the securement aperture arranged and directed through each of the securement blocks to receive a fastener to spacedly mount the framework relative to a vertical support wall overlying a floor.

7. A muscular leg stretching apparatus as set forth in claim 6 wherein each of the "U" shaped guide straps of each of the respective right and left upper guide means includes a respective right and left interior side edge, each of the interior side edges arranged at a forty-five degree angle relative to a respective support plate to capture a respective right and left flexible line between the "U" shaped guide strap and the respective upper guide pulley.

* * * * *